US008544669B2

(12) United States Patent
Escoto, Jr. et al.

(10) Patent No.: US 8,544,669 B2
(45) Date of Patent: Oct. 1, 2013

(54) CONTAINERS WITH EXTERNAL PROTECTION SHEET

(75) Inventors: John I. Escoto, Jr., St. Paul, MN (US); Stephen C. P. Joseph, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 504 days.

(21) Appl. No.: 12/345,710

(22) Filed: Dec. 30, 2008

(65) Prior Publication Data

US 2009/0166447 A1 Jul. 2, 2009

Related U.S. Application Data

(60) Provisional application No. 61/018,164, filed on Dec. 31, 2007.

(51) Int. Cl.
*B65D 25/36* (2006.01)
*B65D 23/08* (2006.01)

(52) U.S. Cl.
USPC ..... 220/23.91; 40/638

(58) Field of Classification Search
USPC ..... 220/23.91, 737; 40/306, 5, 638
See application file for complete search history.

(56) References Cited

U.S. PATENT DOCUMENTS

| | | | | |
|---|---|---|---|---|
| 3,211,470 | A * | 10/1965 | Wilson | 283/85 |
| 3,674,074 | A | 7/1972 | Lavis | |
| 4,816,305 | A * | 3/1989 | Stillwell et al. | 428/35.7 |
| 4,873,193 | A * | 10/1989 | Jensen et al. | 436/176 |
| 5,207,458 | A * | 5/1993 | Treichel et al. | 283/81 |
| 5,492,242 | A | 2/1996 | Gall | |
| 5,582,350 | A | 12/1996 | Kosmyna | |
| 5,639,529 | A * | 6/1997 | Gozdecki et al. | 428/40.1 |
| 5,649,471 | A * | 7/1997 | Heynderickx et al. | 99/285 |
| 6,086,697 | A * | 7/2000 | Key | 156/215 |
| 6,550,171 | B1 * | 4/2003 | De Werra et al. | 40/638 |
| 6,709,017 | B2 | 3/2004 | Ross | |
| 6,820,824 | B1 | 11/2004 | Joseph et al. | |
| 6,953,155 | B2 | 10/2005 | Joseph et al. | |
| 6,986,436 | B2 * | 1/2006 | Smith | 220/660 |
| 7,087,298 | B2 * | 8/2006 | Key | 428/343 |
| 7,273,146 | B2 * | 9/2007 | Brown | 206/497 |
| 2002/0185212 | A1 | 12/2002 | Schaupp | |
| 2003/0059347 | A1 * | 3/2003 | Ostgaard et al. | 422/102 |
| 2003/0177674 | A1 * | 9/2003 | Miller | 40/27.5 |
| 2003/0217489 | A1 * | 11/2003 | Witkowski | 40/306 |
| 2003/0222047 | A1 * | 12/2003 | McRae | 215/373 |

(Continued)

FOREIGN PATENT DOCUMENTS

| | | |
|---|---|---|
| GB | 2294677 | 5/1996 |
| JP | 3-111952 U | 11/1991 |
| JP | 7-13740 U | 3/1995 |
| JP | 11-020830 | 1/1999 |

(Continued)

OTHER PUBLICATIONS

Supplementary European Search Report EP 08 86 9796; Feb. 1, 2011, 2 pgs.

*Primary Examiner* — Anthony Stashick
*Assistant Examiner* — Niki Eloshway
(74) *Attorney, Agent, or Firm* — Philip P. Soo

(57) ABSTRACT

This disclosure pertains to containers and, more specifically, to containers with a releasable protection sheet applied to an exterior surface. The containers described herein are particularly suitable for use with liquid (e.g., paint) spraying devices or spray guns.

13 Claims, 2 Drawing Sheets

(56) References Cited

U.S. PATENT DOCUMENTS

| | | | | |
|---|---|---|---|---|
| 2005/0229450 | A1 | 10/2005 | Larsen | |
| 2005/0279748 | A1* | 12/2005 | Kosmyna | 220/495.02 |
| 2006/0102550 | A1 | 5/2006 | Joseph et al. | |
| 2006/0175434 | A1 | 8/2006 | Escoto, Jr. et al. | |
| 2008/0034627 | A1* | 2/2008 | Schnuckle | 40/306 |
| 2008/0087624 | A1* | 4/2008 | Buckley | 215/230 |
| 2011/0000113 | A1* | 1/2011 | Chadwick | 40/633 |

FOREIGN PATENT DOCUMENTS

| | | |
|---|---|---|
| JP | 2003-519809 | 6/2003 |
| JP | 2005-096870 | 4/2005 |
| JP | 2006-273332 | 10/2006 |
| JP | 2007-537866 | 12/2007 |
| WO | WO 01/50443 | 7/2001 |
| WO | WO 03/097471 | 11/2003 |
| WO | WO 2005-115632 | 12/2005 |

* cited by examiner

CONTAINERS WITH EXTERNAL PROTECTION SHEET

CROSS-REFERENCE TO RELATED APPLICATION

This application claims priority to U.S. Provisional Patent Application No. 61/018,164, filed Dec. 31, 2007, the disclosure of which is incorporated by reference herein in its entirety.

FIELD

This disclosure pertains to containers and, more specifically, to containers with a releasable protection sheet applied to an external wall surface of the container. The containers described herein are particularly suitable for use with liquid (e.g., paint) spraying devices or spray guns.

BACKGROUND

Containers exist in many different fields and are applied to many different uses. Some containers are considered permanent and can be repeatedly used until the lifecycle of the container is extinguished. Other containers are considered disposable and can be discarded after a single use or after several uses, typically less than the number of uses obtained from a permanent container.

One field where containers are used is spraying devices such as spray guns. Spray guns are generally well known and typically comprise a reservoir, or container, in which a liquid to be sprayed is contained. Both permanent and disposable containers have been used as spray gun reservoirs and in some applications the containers are transparent or translucent to allow the user to view the contents inside the container.

When operated, spray guns generally discharge a liquid (e.g., paint, chemicals, adhesives etc.) through a spray nozzle. The release of the liquid through the spray nozzle frequently results in a fine peripheral mist of extraneous liquid discharge, known as "overspray." During spraying operations the overspray builds up on exterior of the spray gun container. When a pigmented liquid is used, the overspray build-up, if left uncleaned, can obscure the spray gun container over time.

Spray gun containers can also be obscured and contaminated by dirty working habits. For example, spilling and splattering can occur when filling and re-filling the container and the container can also be contaminated by dirty hands or by being placed on soiled surfaces.

Since spray gun containers may be constructed of transparent or translucent materials, overspray accumulation and obscuring of the containers prevents an operator from using container filling indicia, from observing the liquid level in the reservoir during operations, and from accurately refilling or "topping off" the spray gun reservoir with fresh liquid. Ultimately, residue accumulation on any type of spray gun container can lead to premature replacement of the container.

SUMMARY

In one aspect the invention relates to a container having an interior surface and an exterior surface and comprising a sidewall that has an interior surface and an exterior surface and that defines an opening at one end thereof and a bottom support surface at an opposite end thereof. The container further includes at least one protection sheet adhered to at least a portion of the exterior surface of the container to protect that portion of the container's exterior surface from contamination. The protection sheet has at least one release mechanism that forms a detaching point for removing at least a portion of the outermost protection sheet and any contamination thereon.

Containers according to the invention are particularly suited for use with a device for spraying paint where the contamination is caused by paint overspray although the containers may be used with other liquid spray devices and in other applications.

In other embodiments the protection sheet may have at least one removable window of material and the release mechanism forms a detaching point for removing at least a portion of the window of material and any contamination thereon.

The container may further comprise a bottom wall that intersects the sidewall. The bottom wall and the opposite end of the sidewall may cooperate to provide the bottom support surface of the container or the bottom wall may be recessed relative to the opposite end of the sidewall such that the opposite end of the sidewall provides the bottom support surface of the container. Optionally, the bottom wall may further include an air opening formed therein. In embodiments that include a bottom wall, the protection sheet may be adhered to at least a portion of the bottom wall on the exterior surface of the container, at least a portion of the exterior surface of the sidewall, or both.

The container may include a plurality of protection sheets arranged in an overlapping configuration. In such embodiments each protection sheet may include an outward facing surface that has a layer of release material thereon and a contacting surface opposite the outward facing surface and with a pressure sensitive adhesive thereon. Providing a plurality of protection sheets allows successive sheets to be removed as each becomes contaminated.

The release mechanism may be provided by a variety of constructions including a portion of the protection sheet contacting surface that does not have a pressure sensitive adhesive thereon or by pre-perforating a section of the protection sheet.

DETAILED DESCRIPTION

To promote an understanding of the principles of the present disclosure, descriptions of specific embodiments follow and specific language is used to describe those embodiments. It will nevertheless be understood that no limitation of the scope of the present disclosure is intended by the use of this specific language. Alterations, further modifications, and such further applications of the principles of the present disclosure are contemplated as would normally occur to one ordinarily skilled in the art to which the disclosure pertains.

Where numerical ranges are used herein, the recitation of numerical ranges by endpoints includes all numbers subsumed within the range (e.g. 1 to 5 includes 1, 1.5, 2, 2.75, 3, 3.80, 4 and 5).

Figure 1:
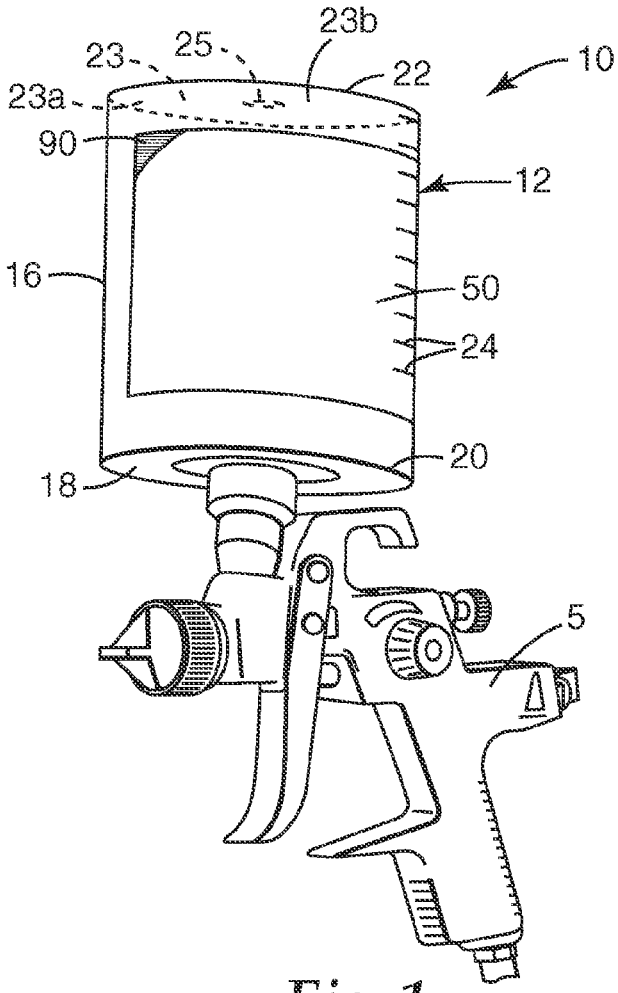
FIG. 1 illustrates an exemplary container with a protection sheet and a protection sheet release mechanism in one embodiment of the present disclosure, wherein the container is mounted on a liquid spraying device.

Referring to FIG. 1, an exemplary container 10 according to one embodiment of the present disclosure is shown. Container 10 includes one or more protection sheets 50 and may include a protection sheet release mechanism 90. In the embodiment shown in FIG. 1 container 10 is disposed on a typical paint spray gun 5 of the gravity-feed type. Such spray guns are described in U.S. Pat. Nos. 6,820,824 and 6,953,155 as well as U.S. Pat. Application Nos. 2006/0102550 and 2006/0175434, the entire contents of all of which are incorporated by reference herein. Container 10 may also be utilized with other types of liquid spray guns known in the art such as siphon-fed and pressurized spray guns. The liquid containers on these types of spray guns are typically located adjacent to the spray gun's fluid outlet and are subject to overspray contamination.

Figure 2:
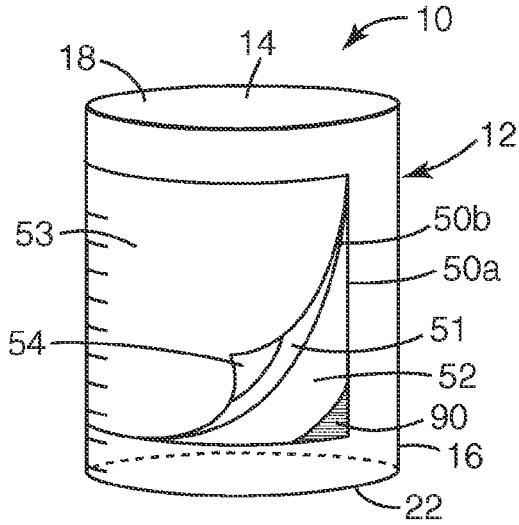
FIG. 2 is a perspective view of an exemplary container with a protection sheet and a protection sheet release mechanism according to another embodiment of the present disclosure.

As shown in FIGS. 1 and 2 exemplary container 10 comprises a generally cylindrical sidewall 12 having an interior surface 14 and an exterior surface 16. Sidewall 12 defines an opening 18 at a top end 20 of the sidewall while a bottom end of sidewall 12 provides a bottom support surface 22 opposite opening 18. In some embodiments container 10 may comprise a single continuous sidewall 12. For example, sidewall 12 may be generally round, cylindrical or oval in shape. In other embodiments container 10 may comprise a plurality of sidewalls. For example, container 10 may have a square, hexagonal, octagonal, or other polygonal shape. Additionally, sidewall 12 of container 10 may have a complex shape formed from combinations of curved and polygonal sections. Thus, as used herein, reference numeral 12 will refer to one or more sidewalls of the container.

Container 10 may also comprise countersunk or recessed sections of sidewall 12 in which protection sheets 50 may reside. In such an embodiment, protection sheets 50 can be added to container 10 without substantially increasing the girth or external circumference of the container. Sidewall 12 may bear indicia 24 to indicate the liquid level in container 10, to convey other information to the user, or to provide a decorative design. Such indicia may be trademarks, brand names, other words, drawings, symbols, and the like.

A more detailed representation of container 10 with protection sheets 50 and protection sheet release mechanism 90 according to one embodiment of the present disclosure is shown in more detail in FIG. 2. In this embodiment the bottom edge of sidewall 12 provides bottom support surface 22 for container 10 without additional material. In this embodiment exterior surface 16 of sidewall 12 defines the exterior surface of container 10 and interior surface 14 of sidewall 12 defines the interior surface of container 10.

In other embodiments, such as shown in FIG. 1, container 10 further includes a bottom wall 23 that intersects sidewall 12. Bottom wall 23 includes an interior surface 23*a* and an exterior surface 23*b*. In this embodiment interior surfaces 14 and 23*a* of, respectively, sidewall 12 and bottom wall 23 cooperate to define the interior surface of container 10 and exterior surfaces 16 and 23*b* of, respectively, sidewall 12 and bottom wall 23 cooperate to define the exterior surface of container 10.

Bottom wall 23 may enclose the entire bottom end of sidewall 12 so as to close the bottom end of container 10. Alternatively, bottom wall 23 may be provided with an air opening 25, the cross-sectional area of which may be relatively small or relatively large as compared to the cross-sectional area circumscribed by the bottom end of sidewall 12.

Bottom wall 23 may intersect sidewall 12 at the sidewall's bottom end such that bottom wall 23 and the bottom end of sidewall 12 collectively provide bottom support surface 22 for container 10. In other constructions bottom wall 23 may be recessed relative to the bottom end of sidewall 12 such that the sidewall's bottom end provides bottom support surface 22 for container 10.

In some embodiments protection sheet 50 may cover the entire exterior surface 16 of sidewall 12, bottom support surface 22 (whether provided by the bottom end of sidewall 12 alone or in combination with bottom wall 23), as well as top end 20 of the container 10. In other words, the protection sheet may cover the entire exterior surface of container 10. In other embodiments, for example as shown in FIGS. 1 and 2, protection sheet 50 may cover less than the entire exterior surface of container 10.

As shown in the exemplary embodiment of FIG. 2, a first protection sheet 50*a* is applied to at least a portion of the exterior surface 16 of sidewall 12 of container 10. The first protection sheet 50*a* has an outward facing surface 52 and a contacting surface (not shown) opposite outward facing surface 52.

A second protection sheet 50*b* may be disposed over first protection sheet 50*a*. Second protection sheet 50*b* has an outward facing surface 53 and a contacting surface 51. In some embodiments the second protection sheet 50*b* may have similar dimensions to first protection sheet 50*a* and may be positioned over first protection sheet 50*a*. In other embodiments second protection sheet 50*b* may be applied by overlapping first protection sheet 50*a* such that at least a portion of second protection sheet 50*b* covers at least a portion of first protection sheet 50*a*. In these embodiments second protection sheet 50*b* may be in direct contact with at least a portion of exterior surface 16 of container 10.

The containers disclosed herein are configured with at least one protection sheet 50. In some embodiments twenty-five or more protection sheets 50 may be disposed on the container 10; in other embodiments at least ten protection sheets 50 may be disposed on the container 10, and in further embodiments at least a single protection sheet is disposed on the container 10. An exemplary embodiment contains about ten protection sheets 50 disposed on container 10. About ten protection sheets allows an end-user a number of sheet removals before exhausting the supply of protection sheets, yet the user is not burdened by the bulk associated with a greater number of sheets. As one skilled in the art may appreciate though, any number of protection sheets may be applied to container 10.

As indicated above, one or more protection sheets may be applied to container 10. It may also be desirable to separately provide replacement protection sheets to further extend the life of the container. The replacement sheets may be adhered to the container once the original protection sheets have been exhausted.

The length and width of the protection sheets may be variously configured to cover a portion of or all of the container surfaces. While many of the embodiments described herein focus on covering the sidewall or sidewalls of the container, one skilled in the art would appreciate that the top or bottom surfaces (or walls) of the container may also be covered with one or more protection sheets.

The thickness of the protection sheets may be manipulated as desired. In some embodiments the protection sheets may be up to 5 mils or more in thickness. In other embodiments the protection sheets may be about 5 mils or less and, in further embodiments, about 3 mils or less.

As further shown in the exemplary embodiment in FIG. 2, a protection sheet release mechanism 90 is included on the protection sheets. An exemplary protection sheet release mechanism 90 provides a corner 54 of protection sheet 50*b* that is free from adhesive on its contacting surface 51, which allows the user to easily remove the protection sheet. In other embodiments the protection sheet release mechanism 90 can take the form of a substrate adhered to the contacting surface of corner 54, thus forming a detaching point which accommodates simple manual removal of the protection sheet.

In other embodiments protection sheet release mechanism 90 may comprise a pre-perforated section or weakened section on protection sheets 50 that allows the user to pull a single sheet away from a body of protection sheets. For example, in embodiments where the protection sheets cover the entire exterior surface of the sidewall(s), a pre-perforated section facilitates removing a single protection sheet. In other embodiments protection sheet release mechanism 90 may comprise a ripping yarn. Generally any mechanism allowing one protection sheet 50 to be released from a second protection sheet 50 or from container sidewall 12 to which the protection sheet is adhered may be used.

Figure 3:
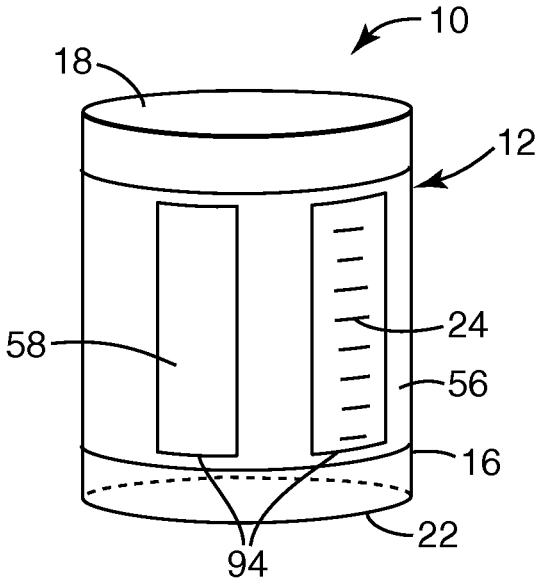
FIG. 3 is a perspective view of a further exemplary container with a protection sheet and a protection sheet release mechanism according to a further embodiment of the present disclosure.

Referring to FIG. 3 a different embodiment of the present disclosure is shown. The elements and features corresponding to elements and features in the illustrated embodiment of FIGS. 1-2 are provided with the same reference numerals. In the exemplary embodiment shown in FIG. 3, a first protection sheet 56 is applied to at least a portion of sidewall 12 of container 10. The first protection sheet 56 comprises a plurality of protection sheet release mechanisms 94 formed by pre-perforating sections of protection sheet 56. As one skilled in the art may appreciate, protection sheet release mechanisms 94 may take the form of any of the release mechanisms previously described herein. Protection sheet release mechanisms 94 facilitate the removal of strips or windows 58 of protection sheet material, allowing exposure of, for example, filling indicia 24. In some embodiments, filling indicia or other markings are on the container sidewall and observable through transparent strips or windows of protection sheet material. In other embodiments, filling indicia or other markings are printed on each strip or window of protection sheet material. The phrase "strip or window of protection sheet material" 58, as used herein, refers to a portion of protection sheet material which is smaller in size than the size of the entire protection sheet 56. As one skilled in the art may appreciate, multiple layers of protection sheets 56 with removable windows 58 may be applied to container 10 to form a container with desired functionality.

In a further embodiment the present disclosure provides removable strips or windows 58 of protection sheet material without the larger interconnecting protection sheets 56. In this embodiment, at least a portion of the container is covered by discrete strips or windows of protection sheet material and the container surfaces between the discrete sections of strips or windows are substantially free from protection sheet material. As one skilled in the art will appreciate, each discrete section of protection sheet material can have multiple layers of strips or windows, and each strip or window layer can have a detachment point (e.g., a substrate adhered to the contacting surface of one corner of each strip or window to form a detaching point which accommodates simple manual removal of the protection sheet). The removable strips or windows of protection sheet may be transparent, translucent, or opaque, and they may bear indicia or other markings, for example, indicating the liquid level in container.

In one embodiment the removable strips may bear volumetric markings which aid a user in measuring additional liquid to be added to the container. In one example the removable strip is removed from its initial position and re-attached on a surface of the container with one end in alignment with the level of liquid in the container. The user may then use the markings on the removable strip to measure additional liquid to be added to the container. In a further example, the user may remove a strip of protection material and hold it inside the container with one end of the strip in alignment with the level of the liquid in the container. Once positioned, the user may use the markings on the removable strip to measure additional liquid to be added to the container. Stated in another way, the removable strips in these embodiments may be used in the same way as a volumetric ruler to aid a user in adding a specific amount of additional fluid to the container.

Container 10 may be formed from materials well-known in the art, including, but not limited to, plastic materials such as polyethylene, polypropylene or polyamide (e.g., nylon). Container 10 may be transparent, translucent, or substantially opaque and may be of any suitable size, although containers for spray guns typically have a capacity of about 150, 500, or 1000 ml.

In a further embodiment of the disclosure a transparent or translucent container may be used with a protection sheet that is opaque or substantially opaque. Used in this way, the protection sheets may convert a transparent or translucent container to an opaque container when light-sensitive materials are used.

One skilled in the art will appreciate that the protection sheets can be formed from many known materials. Exemplary materials may be transparent or translucent to allow visual observation of a liquid level in the container. As described above, opaque or substantially opaque materials may be used as well. By way of non-limiting example, materials used to form the protection sheets may include polyolefins, polyester, polycarbonate, acrylic, polyurethanes, poly acetyl, acetate polymers, epoxy polymers, and/or blends thereof. Exemplary embodiments of the protection sheets comprise polypropylene, unplasticized polyvinyl chloride, acetate, and/or blends thereof.

The protection sheets can optionally include additives, fillers, and stabilizers. These additional components can, for example, increase the durability of the protection sheets and impart chemical and moisture resistance. As one skilled in the art will appreciate, imparting moisture and chemical resistance to the protection sheets helps keep the sheets from being affected by changing atmospheric conditions or from being harmed by chemical agents. Other exemplary protection sheet additives include tinting agents, pigments, UV light blocking agents, and anti-static agents.

The protection sheets further comprise bonding means for releasably attaching sheets to the container wall or to each other. An exemplary bonding means is a layer of adhesive, either pressure sensitive adhesive or non-pressure sensitive adhesive, disposed on a first major surface of a protection sheet material. Adhesive materials suitable for the present disclosure include but are not limited to those selected from the group consisting of acrylics, rubbers, including thermoplastic rubbers, block copolymers, natural rubbers or silicone rubbers, polyolefins and/or blends thereof.

One embodiment of the present disclosure utilizes a pressure sensitive acrylic adhesive. While the adhesive may be applied as a solid or continuous layer of material in some embodiments, the adhesive may also be discontinuously coated in a stripe, dot or other pattern to limit adhesion build, thus making the protection sheets easier to remove.

An optional release layer may also be included on the protection sheets when adhesive bonding means are employed. The release layer is applied to a second major surface of the protection sheet material which is opposite the first major surface on which adhesive is applied. The optional release material serves, among other purposes, to reduce the affinity for adhesive when multiple layers of protection sheets are placed atop one another. The reduced adhesive affinity eases the separation of a single protection sheet from the stack of protection sheets.

Materials suitable for use as a release layer in this disclosure include acrylates, urethanes, polyolefins, including polyethylene, fluorochemicals, silicones, vinyl copolymers and/or combinations thereof.

In addition to the materials described above, the protection sheets may also be constructed from commercially available materials. Exemplary commercial materials include: polypropylene film sheets with an acrylic pressure sensitive adhesive layer available from 3M Company (St. Paul, Minn.) under the brand name Highland™ Transparent Tape 5910; unplasticized polyvinyl chloride film sheets with an acrylic pressure sensitive adhesive layer available from 3M Company (St. Paul, Minn.) under the brand name Scotch® Transparent Film Tape 600; and acetate film sheets with an acrylic backing layer available from 3M Company (St. Paul, Minn.) under the brand name Scotch® LabelGard™ Film Tape 821.

As described above, in some embodiments the protection sheets may bear indicia, for example, indicating the liquid level in the container, or communicating trademarks, brand names, logos and the like. As one skilled in the art may appreciate, any written, symbolic, or graphic image may be applied to the protection sheets.

The protection sheets may be applied to the container by known methods, and the container may be coated with an adhesion promoter or corona treated to facilitate the adhesion of the protection sheets.

The protection sheets described herein may be configured to self-roll upon removal in order to contain paint overspray and prevent contamination of the surface being painted.

The protection sheets described herein may also be configured with a low-static surface to prevent the build-up of static charge.

As may be further appreciated by one skilled in the art, the protection sheets may further contain surface features to assist the user in locating an edge of the protection sheet for ease of removal.

Although the invention has been described and illustrated in detail with respect to specific embodiments thereof, it is to be clearly understood that the description and illustration is not to be taken by way of limitation.

What is claimed is:

1. A container for use with a paint spray gun having an interior surface and an exterior surface and comprising:

a sidewall having an interior surface and an exterior surface and defining an opening at one end thereof adapted for connecting the container to the paint spray gun and a bottom support surface at an opposite end thereof; and a plurality of protection sheets arranged in an overlapping configuration and adhered to at least a portion of the exterior surface of the sidewall to protect that portion of the sidewall's exterior surface from contamination during operation of the paint spray gun, wherein each of the plurality of protection sheets has at least one removable window of material that is transparent or translucent to allow visual observation of a paint level in the container and has at least one release mechanism that forms a detaching point for removing from the container the at least one removable window of material of the outermost protection sheet and any contamination thereon, wherein the paint level in the container is indicated by filling indicia or other markings provided either on the sidewall or on at least one protection sheet.

2. A container according to claim 1 wherein each of the plurality of protection sheets comprises a UV light blocking agent.

3. A container according to claim 1 and further comprising a bottom wall that intersects the sidewall.

4. A container according to claim 3 wherein the bottom wall and the opposite end of the sidewall cooperate to provide the bottom support surface of the container.

5. A container according to claim 3 wherein the bottom wall is recessed relative to the opposite end of the sidewall and the opposite end of the sidewall provides the bottom support surface of the container.

6. A container according to claim 3 wherein the bottom wall further includes an air opening formed therein.

7. A container according to claim 3 wherein at least one protection sheet is adhered to at least a portion of the bottom wall on the exterior surface of the container.

8. A container according to claim 1 wherein the exterior surface of the sidewall includes a recessed area and at least one protection sheet is adhered to at least a portion of the exterior surface of the sidewall that includes the recessed area.

9. A container according to claim 1 wherein each of the plurality of protection sheets includes an outward facing surface having a layer of release material thereon and a contacting surface opposite the outward facing surface and having a pressure sensitive adhesive thereon.

10. A container according to claim 9 wherein the release mechanism is provided by a portion of each protection sheet contacting surface that does not have a pressure sensitive adhesive thereon.

11. A container according to claim 9 wherein the release mechanism is provided by a section of at least one protection sheet that is pre-perforated.

12. A container according to claim 1, wherein the paint level in the container is indicated by filling indicia or other markings provided on each protection sheet.

13. A method of removing contamination from a paint spray gun container, the container including a sidewall with an interior surface and an exterior surface and an opening adapted for connection to the paint spray gun, the method comprising:

adhering to at least a portion of the exterior surface a plurality of protection sheets arranged in an overlapping configuration to protect that portion of the sidewall's exterior surface from contamination during operation of the paint spray gun, each of the plurality of protection sheets being transparent or translucent to allow visual observation of a paint level in the container relative to filling indicia or other markings provided either on the sidewall or on at least one protection sheet; and detaching from the container at least a portion of the outermost protection sheet to remove any contamination thereon to preserve exposure of the filling indicia or other markings.

* * * * *